US008112965B2

(12) United States Patent
Chmelar

(10) Patent No.: US 8,112,965 B2
(45) Date of Patent: Feb. 14, 2012

(54) ASSEMBLY AND METHOD FOR THE CONSTRUCTION OF MONOLITHIC TIERED CONCRETE SLABS

(76) Inventor: Steve Chmelar, Ottumwa, IA (US)

( * ) Notice: Subject to any disclaimer, the term of this patent is extended or adjusted under 35 U.S.C. 154(b) by 956 days.

(21) Appl. No.: 12/112,157

(22) Filed: Apr. 30, 2008

(65) Prior Publication Data

US 2008/0263970 A1 Oct. 30, 2008

Related U.S. Application Data

(60) Provisional application No. 60/914,909, filed on Apr. 30, 2007.

(51) Int. Cl.
*E04G 21/02* (2006.01)
*E04G 13/06* (2006.01)

(52) U.S. Cl. ..... 52/741.2; 249/14

(58) Field of Classification Search ..... 249/14; 52/741.2; 264/31

See application file for complete search history.

(56) References Cited

U.S. PATENT DOCUMENTS

| | | | | | |
|---|---|---|---|---|---|
| 710,886 | A | * | 10/1902 | Piccardi | 249/14 |
| 802,506 | A | * | 10/1905 | Hanson | 249/14 |
| 932,679 | A | * | 8/1909 | Coleman | 249/14 |
| 1,147,826 | A | * | 7/1915 | Stubblefield | 249/14 |
| 1,586,440 | A | * | 5/1926 | Bilyeu | 249/14 |
| 1,703,633 | A | * | 2/1929 | Newcomb | 249/14 |
| 1,747,036 | A | * | 2/1930 | Sullivan | 249/14 |
| 1,796,306 | A | | 3/1931 | Ruderman et al. | |
| 1,888,686 | A | * | 11/1932 | O'Donnell | 249/14 |
| 2,688,786 | A | * | 9/1954 | Pinner | 249/14 |
| 2,857,646 | A | * | 10/1958 | McLoughlin | 249/14 |
| 2,880,491 | A | * | 4/1959 | Varnado, Sr. | 249/14 |
| 3,134,157 | A | | 5/1964 | Pinner | |
| 3,599,929 | A | * | 8/1971 | Holley et al. | 249/14 |
| 3,613,185 | A | * | 10/1971 | Hacker | 264/32 |
| 3,805,464 | A | * | 4/1974 | Hanson | 52/741.2 |
| 3,814,371 | A | * | 6/1974 | Locricchio | 249/14 |
| 5,174,083 | A | | 12/1992 | Mussell | |

OTHER PUBLICATIONS

"Stadium Seating Solutions", Stadium Seating Enterprises, EPS Geofoam, www.sseseating.com/solutions.htm, Apr. 24, 2008, 17 pages.

"Standard System" Stadium Savers, www.stadiumsavers.com, Apr. 19, 2007, 11 pages.

EPS Review, Enterprising Product Solutions, Innovative Durafill Geofoam based Stadium Savers provides a better tiered seating platform sy stem, www.epsreview.com, vol. 3, Issue 2, 2006, 2 pages.

* cited by examiner

*Primary Examiner* — Michael Safavi

(74) *Attorney, Agent, or Firm* — McKee, Voorhees & Sease, P.L.C.

(57) ABSTRACT

The assembly and method of the present invention is used for forming a monolithic tiered concrete slab or stairway. The assembly includes a plurality of foam blocks positioned adjacent one another and in a plurality of rows on a support base. The upper surfaces of the blocks are sloped and form a continuous included plane from the front row to the back row. Interface elements are attached to the upper surfaces so as to cover the joints between adjacent blocks. Riser ties are mounted on the interface elements, with riser face forms attached to the ties. After the blocks are positioned and the interface elements with riser ties and face forms assembled, concrete is poured under the blocks so as to cover the upper surface, the interface elements, and the ties, thereby forming a monolithic tiered series of risers and treads.

20 Claims, 8 Drawing Sheets

ASSEMBLY AND METHOD FOR THE CONSTRUCTION OF MONOLITHIC TIERED CONCRETE SLABS

CROSS-REFERENCE TO RELATED APPLICATIONS

This application claims priority under 35 U.S.C. §119(e) to provisional application Ser. No. 60/914,909 filed Apr. 30, 2007, herein incorporated by reference in its entirety.

BACKGROUND OF THE INVENTION

The accepted methods of constructing concrete structures designed with a plurality of tiered or stepped levels, such as seating for lecture halls, theaters or stadiums or stairways, is usually determined by the size of the project. Structures, like sports stadiums, are large enough in size to benefit from the ability of using large customized concrete 'gang type' forms that require external means of load transfer from one section of the form to another. Forming smaller structures, like a classroom lecture hall, will often typically be built 'by hand' one component at a time.

The use of 'gang type' forms to build the larger structures can usually provide greater control over dimensional accuracy and installed costs due to a faster cycle of setting the forms, placing the concrete and stripping the forms. Employing 'hand built' construction practices for smaller structures can provide dimensional accuracy but there is increased risk of failure due to the reduced size of the components and fasteners, though the construction cycle will be longer and the labor cost will be higher. The decision ultimately comes down to whether there is enough labor savings to offset the investment in the 'gang type' forms. If the reuse and the labor savings can't be realized with 'gang type' forming methods, then 'hand built' forms are used for the construction, with the acceptance of higher labor costs and associated risks.

It is known in the industry to utilize expanded polystyrene (EPS) foam blocks as a form that supports the tread portion of a tiered concrete floor, for example, for the seating area of a cinematic movie theater. This prior art method does not form a concrete riser, such that the structure does not have the integrity of a monolithic tiered concrete slab having interconnected concrete risers and treads. Typically, this prior art method utilizes a permanent steel plate as the riser. In the event of a fire, the steel plate transfers heat to the underlying foam blocks, which then can melt such that the concrete treads are not evenly supported and eventually fail.

Another prior art method of forming a tired concrete slab requires a base with compacted granular fill which must be retained in a sloped arrangement. Retaining walls are used for retention of the sloped fill material. The retaining walls add additional time and expense to these projects.

Therefore, it is a primary objective of the present invention to provide an improved assembly and method for forming a monolithic tiered concrete slab or stairway.

Another objective of the present invention is the provision of an assembly and method for forming a tiered concrete slab or stairway having a curved riser face.

Another objective of the present invention is the provision of an assembly and method for forming a monolithic tiered concrete slab or stairway for various uses, including auditorium and lecture hall seating.

Another objective of the present invention is the provision of an assembly and method for forming a tiered concrete slab or stairway having minimal heat transfer properties.

Still another objective of the present invention is the provision of an assembly and method for forming a tiered concrete slab or stairway having interconnected concrete treads and risers.

Yet another objective of the present invention is the provision of an assembly and method for forming a tiered concrete slab or stairway which is customized to each individual project.

A further objective of the present invention is the provision of an assembly and method for forming a tiered concrete slab or stairway which is easy to use.

Still another objective of the present invention is the provision of an assembly and method for forming a tiered concrete slab or stairway which is economical and durable.

These and other objectives will become apparent from the following description of the invention.

BRIEF SUMMARY OF THE INVENTION

The invention is directed toward a riser interface assembly and method for constructing a monolithic tiered concrete slabs and stairways using a combination of components that will promote the accurate and efficient construction of a plurality of tiered levels involving riser faces and treads. The distinguishing characteristics of this construction system and method relate to its secure 'interface' between the supporting base, whether permanent or temporary, and the forms for the riser faces. Since very few projects have the same dimensional requirements, it is necessary for a system to be customizable, for example, to accommodate either straight or radial designs. This method uses pre-manufactured, project specific components that are supplied as a system. These 'made to order' parts are assembled at the jobsite more rapidly, more accurately, and with more stability than typical job built forming methods. The benefits of the 'gang type' forms can therefore be realized on smaller projects using the assembly and method of the present invention.

The system components include the following: 1) a permanent, engineered base material, such as, but not limited to, EPS foam that is configured to the lineal, radial, or tapered profile of the project, 2) structural interface elements such as boards (laminated wood veneers, oriented wood strands, or composites) or metal components that are bonded and/or mechanically attached to the engineered fill or base material, 3) special form ties (most often made of, but not limited to, welded steel wire) and 4) riser face forming element such as temporary, very smooth boards (laminated wood veneers, oriented wood strands, or composites with a plastic face to the concrete) or permanent riser faces such as concrete or metal, and 5) sufficient structural framing and forming hardware behind the riser face to control the desired configuration of the concrete riser, whether straight or radial.

The system, as described, is not intended to alter the design requirements of the structural, tiered concrete slabs or stairways. It should be noted that, the substitution of EPS blocks as a permanent base material, in lieu of compacted granular material, can eliminate the retaining walls that are needed to restrain the lateral pressure caused by compaction forces. EPS blocks are designed, tested and rated according to ASTM standards; specific live and dead loads can be permanently supported without the risk of settling. Structural reinforcing requirements should be engineered to meet the specific needs of the intended application.

DETAILED DESCRIPTION OF THE PREFERRED EMBODIMENT

Figure 1:
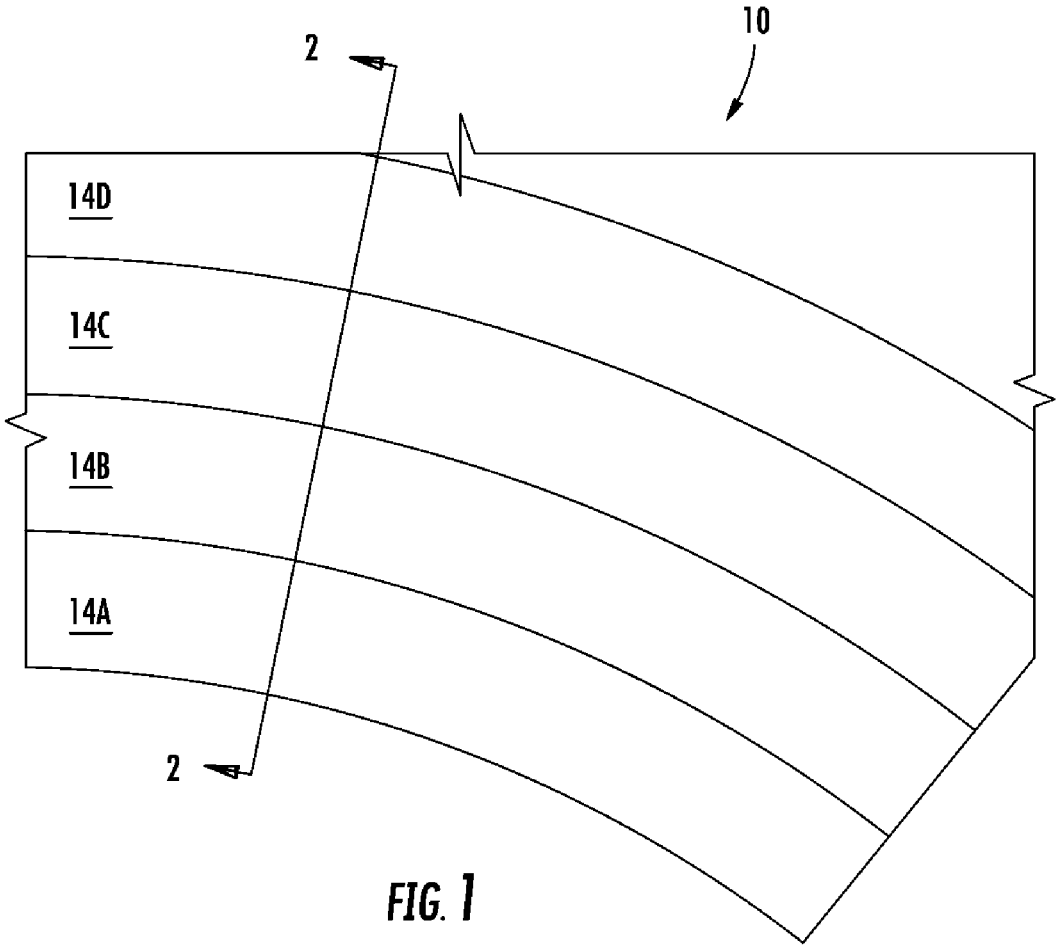
FIG. 1 is a partial plan view of a tiered concrete slab conforming to the radial requirements of a lecture hall (as an example).
Figure 2:
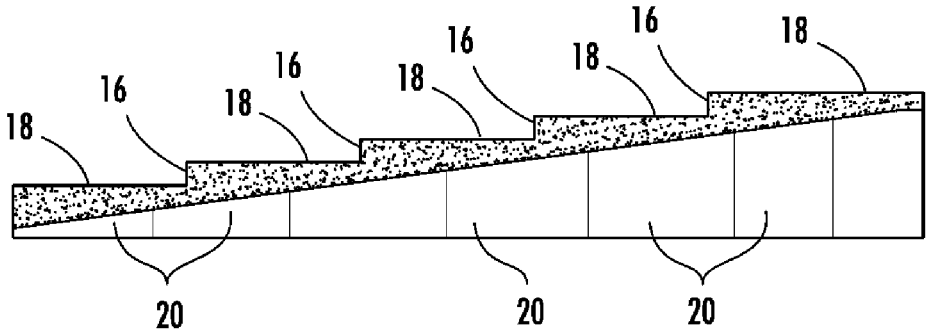
FIG. 2 is a sectional view taken along line 2-2 of FIG. 1.
Figure 3:
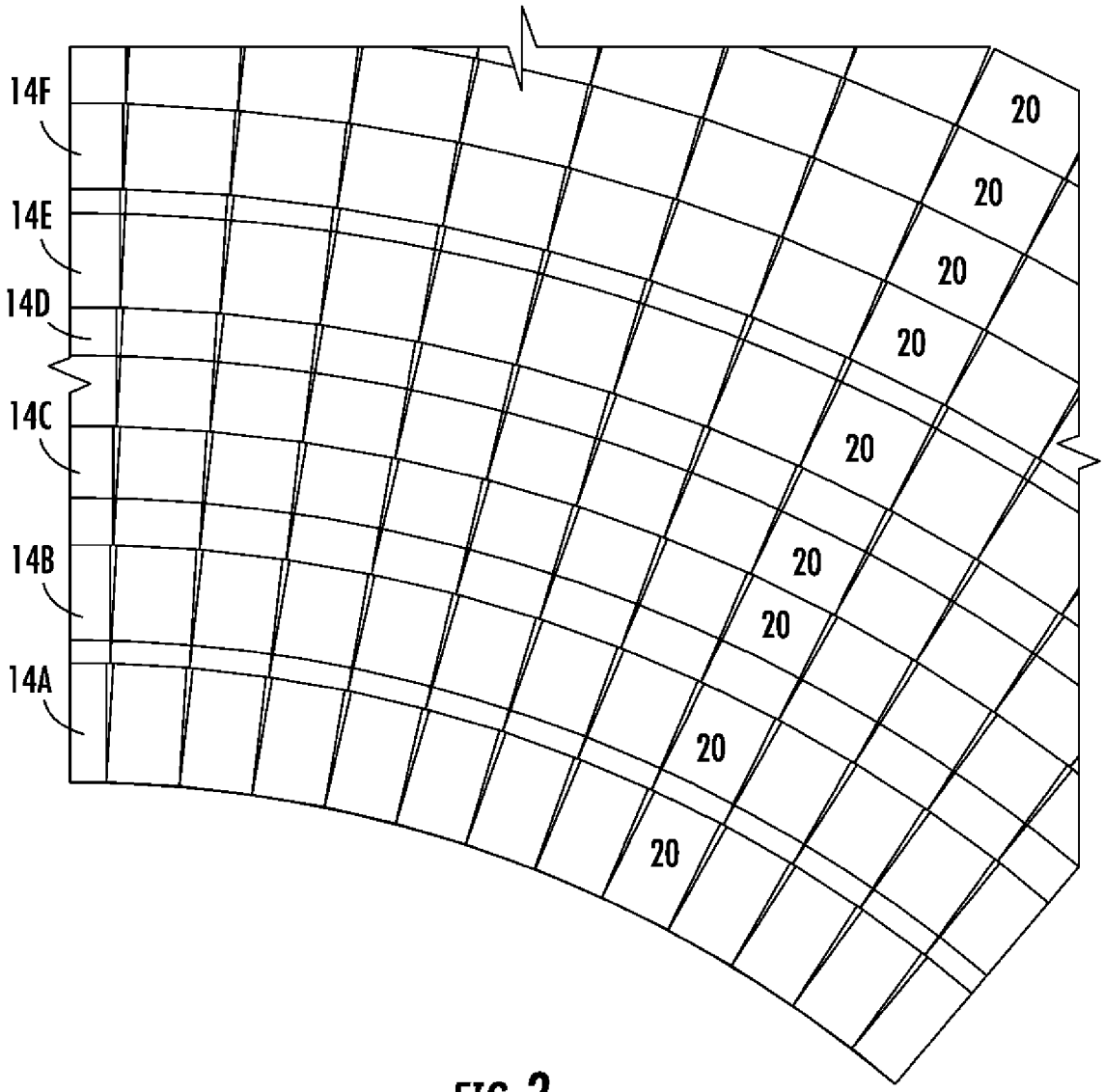
FIG. 3 is a partial plan view showing EPS foam blocks set in position to form a curved tiered concrete slab.
Figure 4:
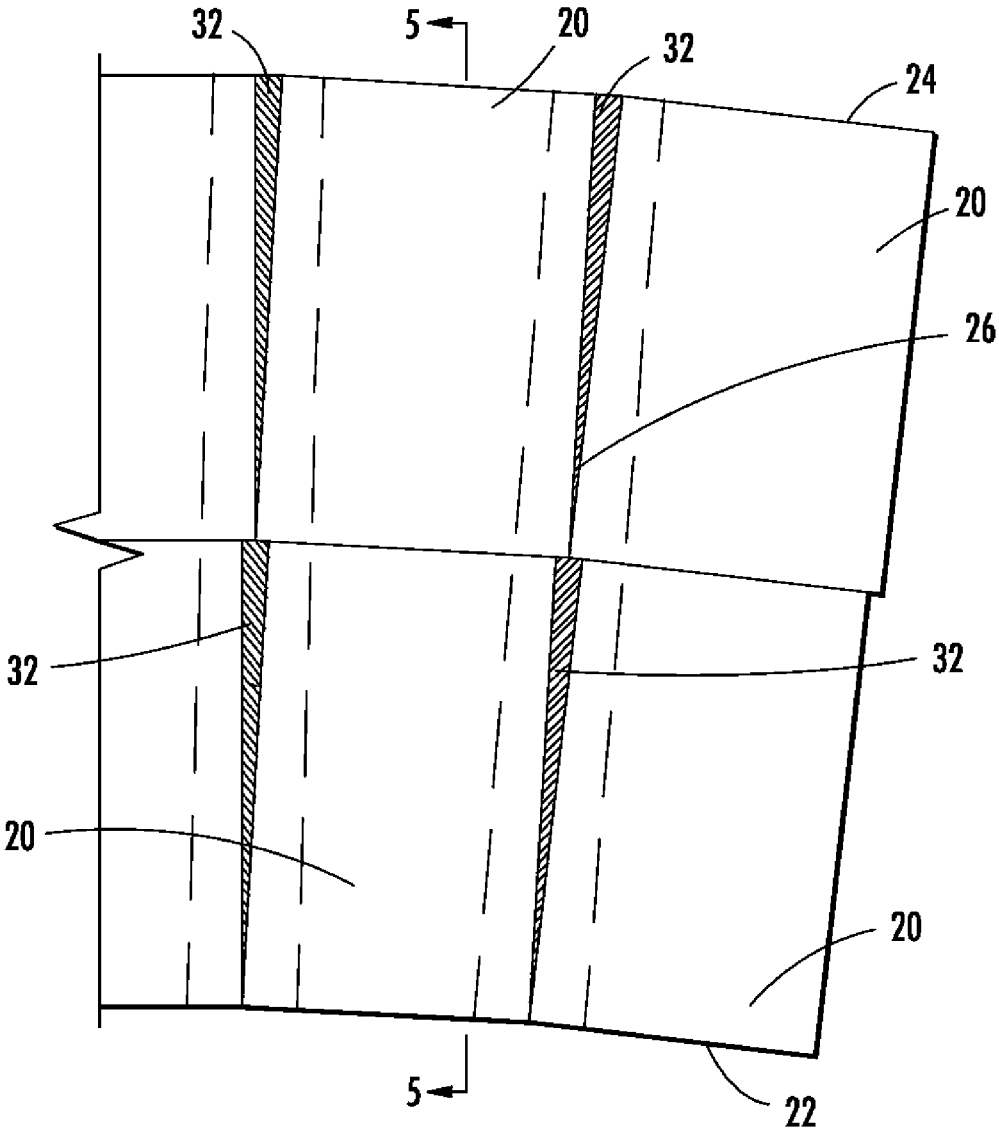
FIG. 4 is an enlarged partial plan view of the EPS foam blocks of FIG. 3.
Figure 5:
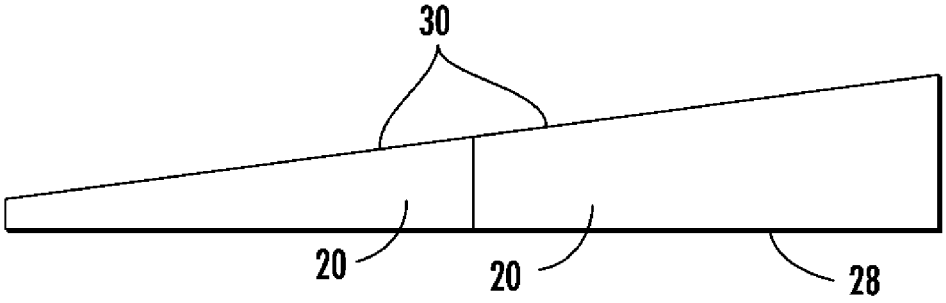
FIG. 5 is a sectional view taken along line 5-5 of FIG. 4.
Figure 12:
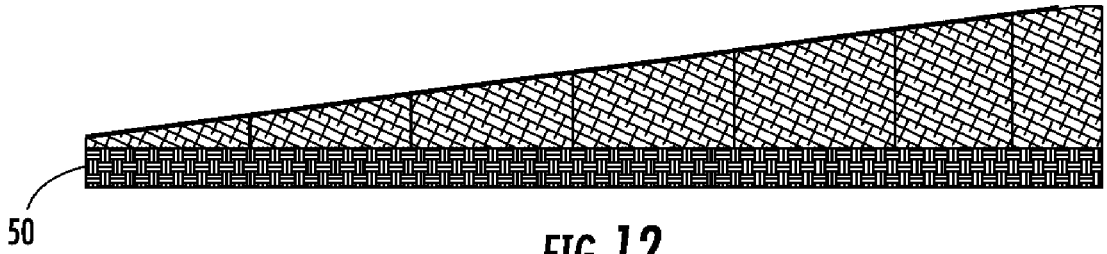
FIGS. 12-14 are section drawings showing the steps in the process for creating the tiered concrete slab using the riser interface assembly according to the present invention.
Figure 13:
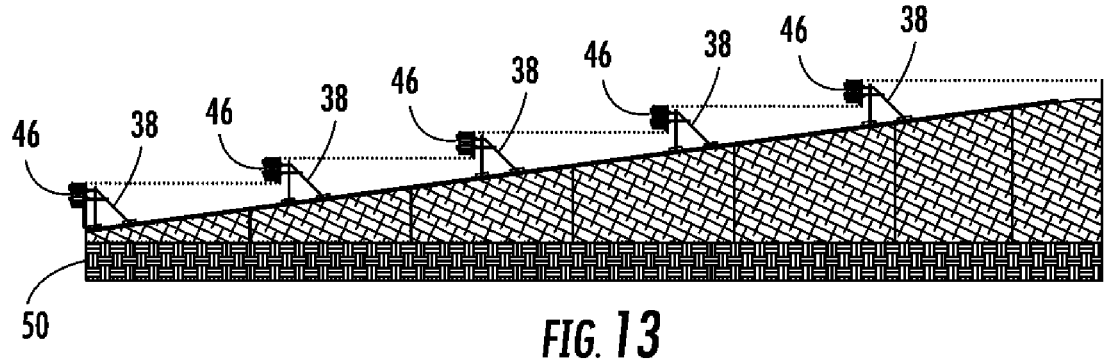
Figure 14:
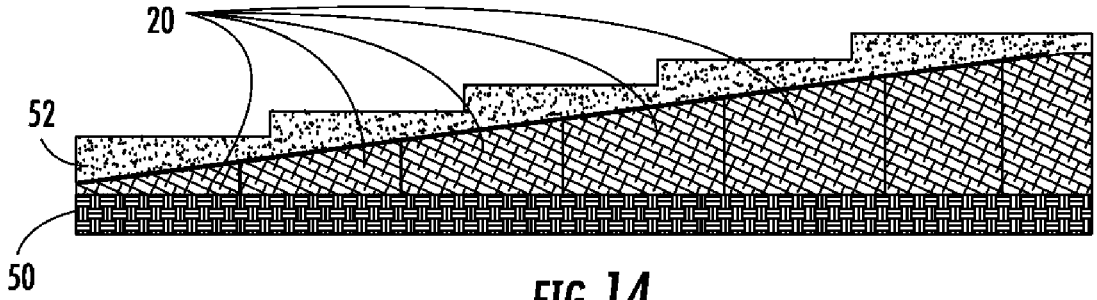

The assembly and method of the present invention is intended for use in the construction of a monolithic, reinforced, tiered concrete slabs 10, or stairways 12, formed in straight rows or about a radius. Each row of the tiered concrete slabs or stairways has a riser 16 and a tread 18. The assembly begins with a plurality of EPS foam blocks 20 which are positioned adjacent each other, as seen in FIGS. 3 and 12 of the drawings. The blocks 20 each have a front edge 22, a rear edge 24, opposite sides 26, a bottom 28 and a sloped top 30. The adjacent blocks 20 define a joint 32 there between. The drawings show the assembly used in creating curved tier levels, although it is understood that straight tier levels can be formed in a similar manner by abutting the adjacent sides 26 of the EPS blocks 20, there between as in the curved tiers. As seen in FIGS. 12-14, the height dimensions of the blocks 20 increasing from the front row A to the rear row of the tiered slab, thereby forming a continuous, smooth, sloping upper surface from front to back. Also, when a curved or radial slab profile is to be formed, the width of the EPS blocks 20 increases from the front row A to the rear row, as best seen in FIGS. 3 and 12.

Figure 6:
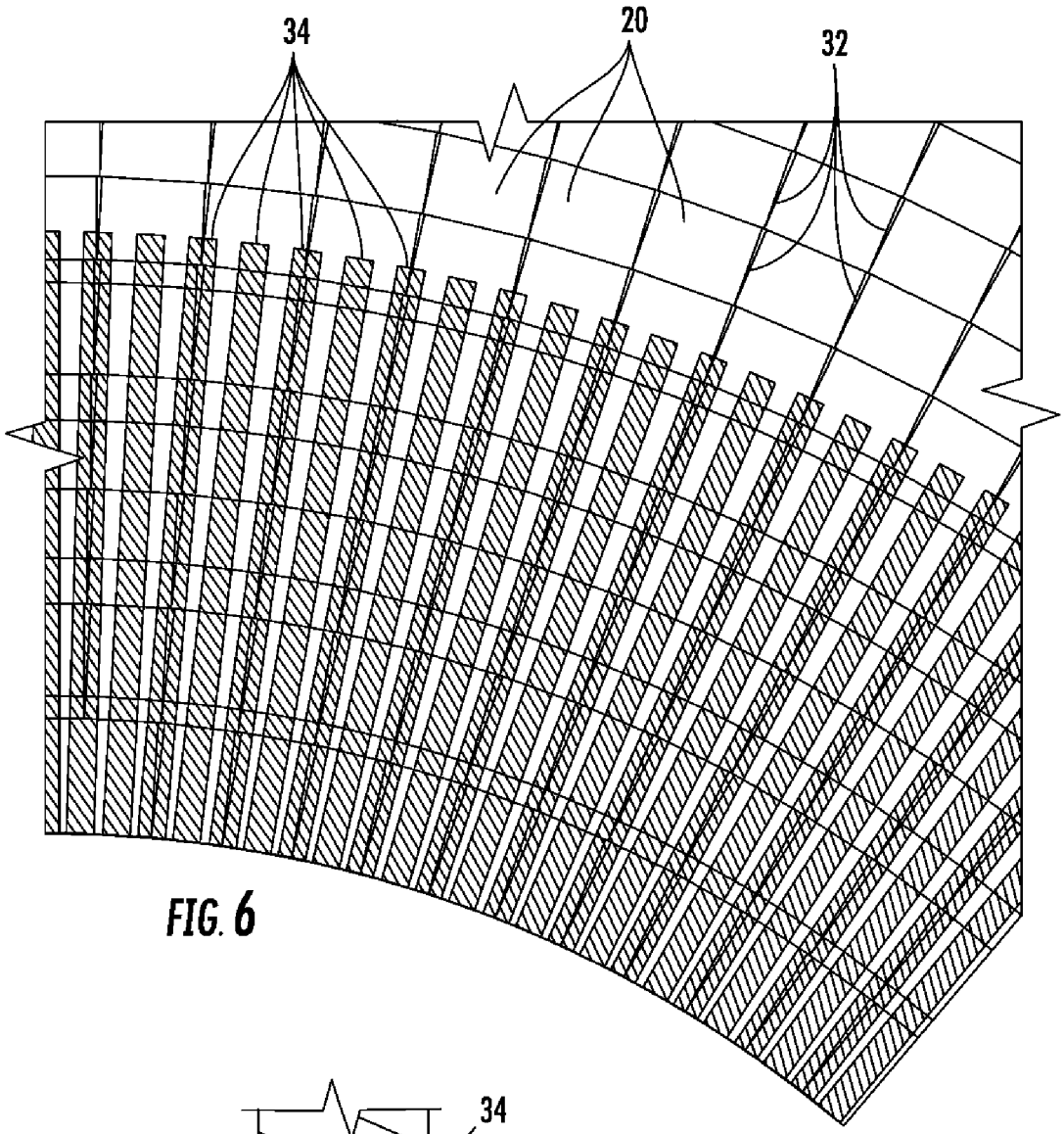
FIG. 6 is a partial plan view similar to FIG. 1, with the structural interface elements added to the EPS blocks.
Figure 7:
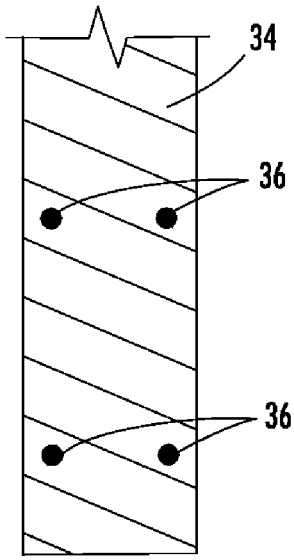
FIG. 7 is an enlarged partial plan view of one of the structural interface elements showing a fastener and fastening points to the EPS blocks.
Figure 8:
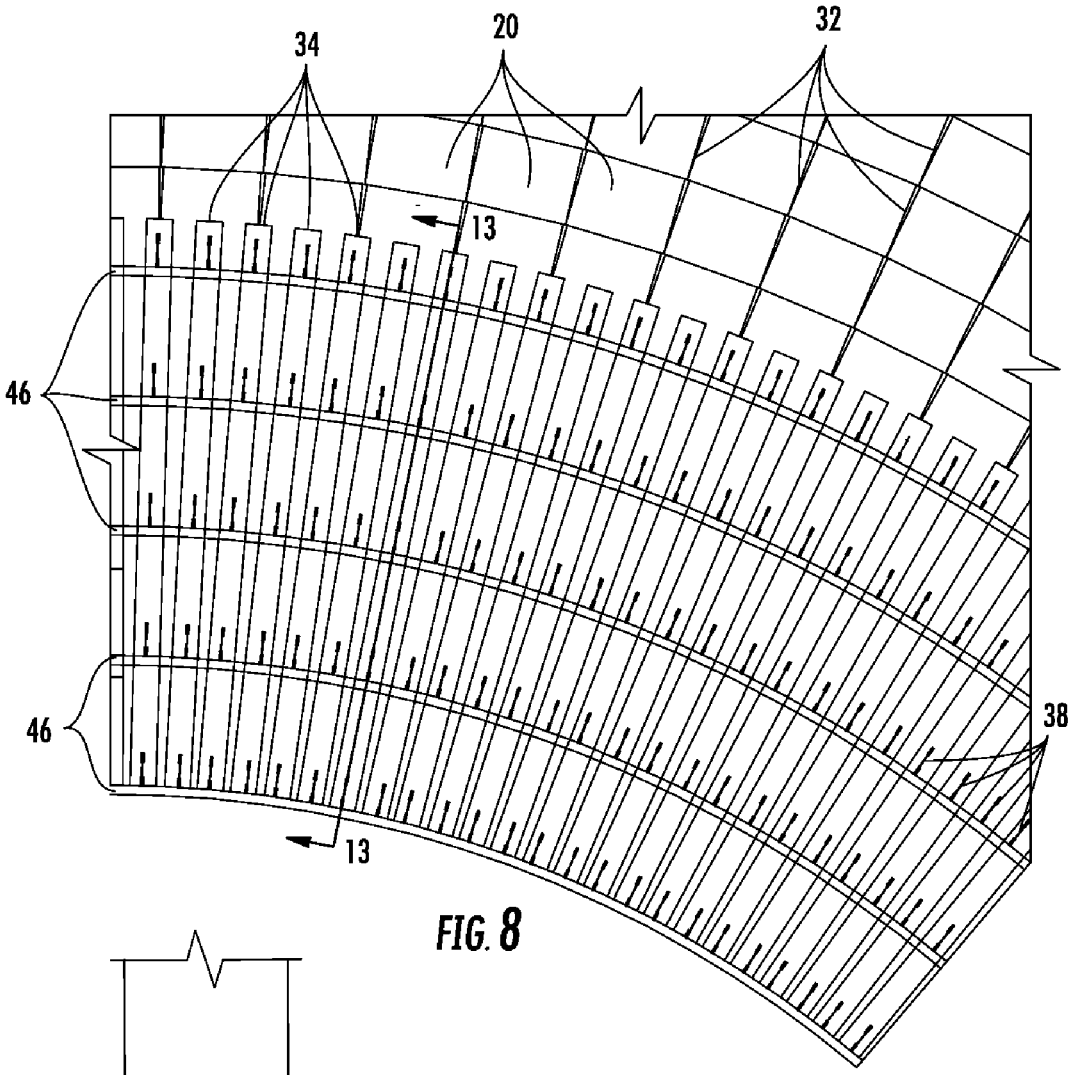
FIG. 8 is a similar partial plan view with the riser face forming element in place.
Figure 9:
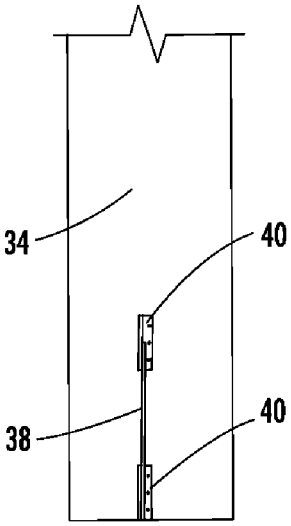
FIG. 9 is a partial plan view of one of the structural interface elements with a wire riser face form tie mounted thereon.
Figure 10:
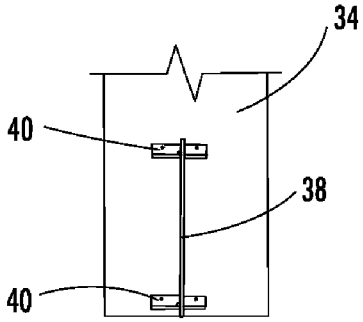
FIGS. 10 and 11 are similar to FIG. 9 and show alternative embodiments for mounting the riser tie to the interface element.

The structural interface elements 34, shown in cross hatching in FIG. 6, are placed over the joints 32 between adjacent EPS blocks 20, and also preferably at the midpoint of the EPS blocks 20, such that the interface 34 extends linearly from the front row to the back row, as seen in FIGS. 6 and 8. A minimum width of 12" is preferred for the element 34 to assure the structural stability of lateral concrete pressures exerted against the riser face forming element. The interface elements 34 may be secured to the EPS blocks 20 using adhesive and/or mechanical anchors, such as the barbed pins 36 shown in FIG. 7.

Figure 11:
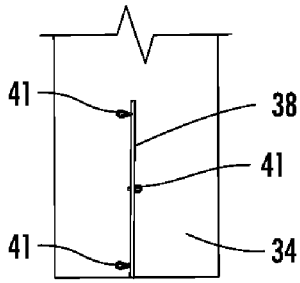
Figure 15:
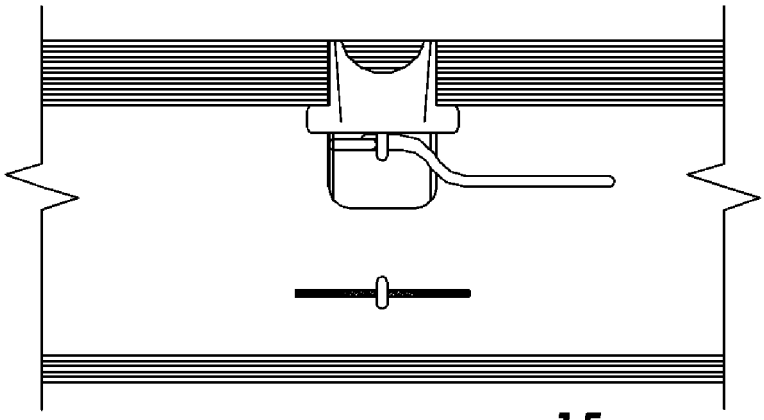
FIG. 15 is an enlarged partial elevation view showing the hardware and framing lumber used with the riser tie.
Figure 16:
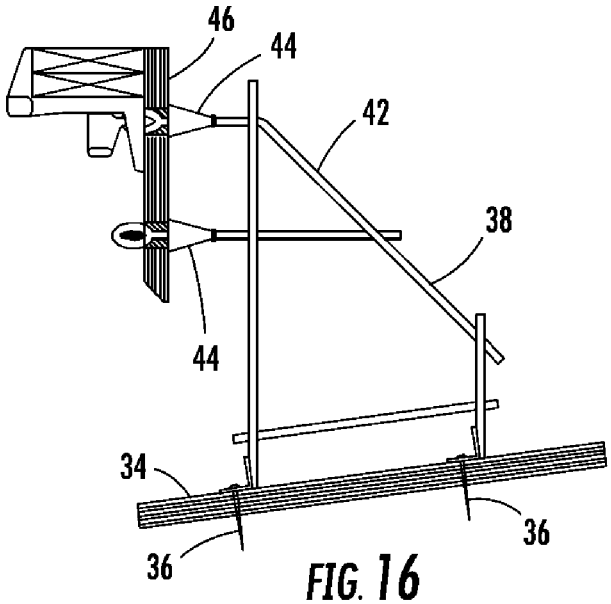
FIG. 16 is an enlarged side elevation view of one of the structural interface elements with a welded wire riser face form tie thereon, and having the riser face form and framing lumber attached to the tie.
Figure 17:
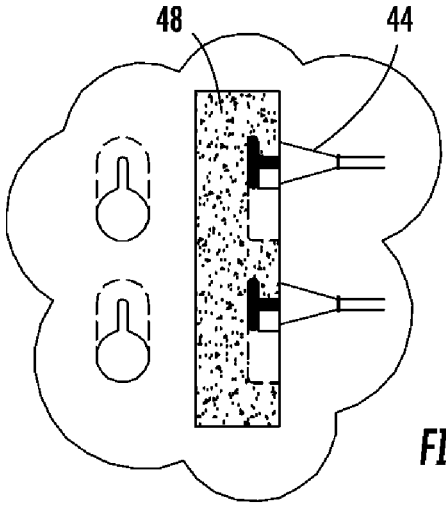
FIG. 17 is a partial view of an alternative permanent concrete face panel used with a riser tie.
Figure 19:
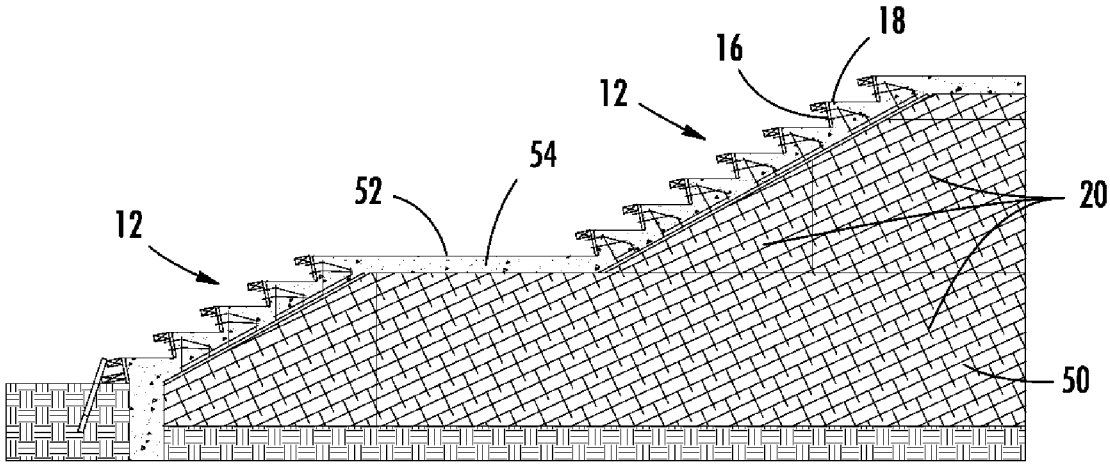
FIG. 19 is a sectional view taken along line 19-19 of FIG. 18.

The fixed length, or adjustable length, riser face form ties 38 are mechanically attached to the interface elements 34 using any convenient fastener, such as screws, extending through front and rear L-shaped angle feet 40. Typical methods of fabricating the angled feet 40 include steel clips welded to the wire tie 38 or a looped wire feature that is integral with the riser tie 38. As an alternative to feet 40, an integral looped wire 41 may be provided for receiving fasteners, as seen in FIG. 11. The riser tie 38 includes a triangular wire body 42, with the wires preferably being welded together, with break-back cones 44 which position the riser face form 46, as best seen in FIG. 16. The form ties 38 must be attached to the structural interface element 34 in a secure manner. This tie 38 can be produced as a singular unit or as a series of ties connected together sharing common structural parts. FIG. 19 illustrates an example wherein double ties have a single wire connecting the identical ties. This system does not require the use of supplemental bracing to achieve dimensional accuracy. According to the architectural design, the riser form face 46 extends vertically, such that the riser 16 of the tiered steps is vertical, as seen in FIG. 14. Ties 38 can be fabricated to the exact requirements of all building codes. The face form 46 may be removably mounted to the riser tie 38, such as shown in FIGS. 15 and 16, or alternatively, may be a permanent face panel 48 made of concrete or other material, as seen in FIG. 17.

The method of forming the tiered concrete slabs 10 or stairways 12 of the present invention is schematically shown in FIGS. 12-14. Once the ground or support base 50 is graded, the foam blocks 20 are mounted thereon, and preferably anchored thereto, as seen in FIG. 12. If the slabs 10 or stairways 12 are to be formed on top of dirt or other particulant material, anchoring pins can be driven downwardly through the foam blocks 20 and/or the dirt or material so as to maintain the blocks in the desired position.

The next step in the method is to attach the structural interface elements 34 to the foam blocks 20, preferably using adhesive and/or mechanical anchors. In the best mode, the riser face form ties 38 are mounted on the structural interface elements 34. If required, shims can be placed under the mounting feet 40 to assure accurate positioning. Then, the riser face forms 46, walers and hardware are mounted on the riser ties 38. As required, the riser face forms 46 will create a smooth, curved riser surface when the blocks 20 are set in a radial alignment around the center point of the riser faces. Similarly, straight or lineal riser configurations will be parallel and accurately positioned. Steel reinforcement rods (not shown) can be positioned, as known in the industry. The concrete 52 is then poured, finished on the treads 18, and allowed to cure. The last step in the process is to remove the riser face forms 46 and framing lumber, unless the permanent face panel 48 is utilized. The structural interface elements 34 and the riser ties 38 remain buried in the concrete 52.

It is understood that this system and method can be used on sloped earth (or particulate material), or on decking (whether temporary or permanent), without the EPS foam blocks 20.

Figure 18:
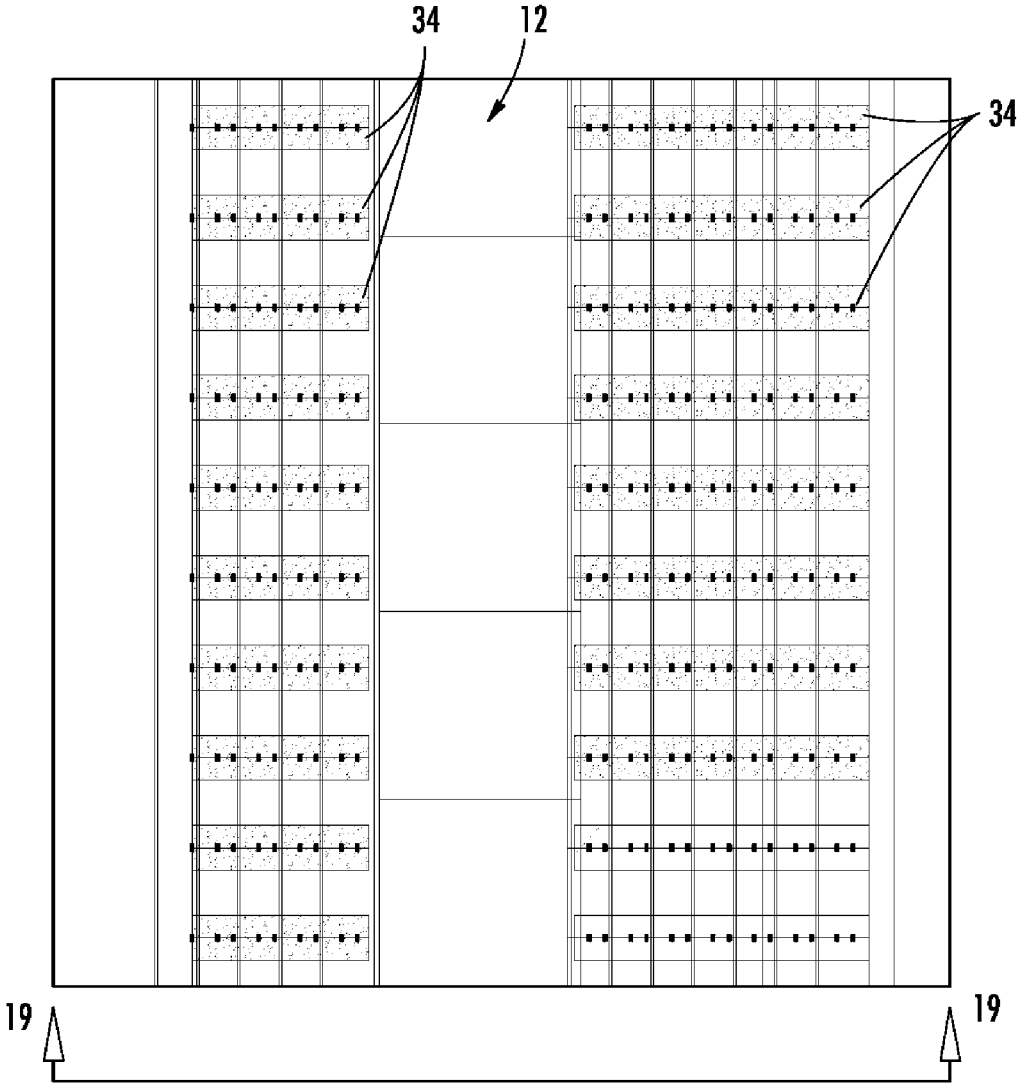
FIG. 18 is a partial plan view of the present invention arranged for forming a stairway with an intermediate landing.

FIGS. 18 and 19 show the assembly as used to form steps 12 with a landing 54. Each step includes a riser 16 and tread 18.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A method of constructing tiered concrete slabs or stairways, comprising:

preparing a support base;

positioning multiple rows of foam blocks on the base adjacent one another, with a joint between laterally adjacent blocks, the blocks forming an inclined upper surface from a front row to a rear row;

attaching interface elements to the blocks so as to cover each joint, the interface elements having riser face form ties mounted thereon;

attaching riser face forms to the riser face form ties; and pouring concrete onto the foam blocks so as to cover the upper surface, the interface elements and the ties so as to form monolithic, tiered risers and treads.

2. The method of claim 1 further comprising finishing the concrete on treads between the face forms in adjacent rows.

3. The method of claim 1 further comprising removing the face forms from the ties after the concrete has cured.

4. The method of claim 1 further comprising anchoring the blocks to the base.

5. The method of claim 1 wherein the interface elements are attached to the blocks using adhesive.

6. The method of claim 1 wherein the interface elements are attached to the blocks with anchors.

7. The method of claim 1 wherein the blocks are positioned in a radial pattern to form a curved riser face.

8. The method of claim 1 wherein the blocks are positioned in a linear pattern to form a straight riser face.

9. The method of claim 1 wherein the riser face form ties are mounted on the interface elements before the elements are attached to the blocks.

10. The method of claim 1 further comprising removing the riser face forms from the riser face form ties.

11. The method of claim 1 wherein the interface elements and riser face form ties remain buried in the concrete.

12. An assembly for forming tiered concrete slabs or stairways upon a support base, comprising:

a plurality of foam blocks positioned adjacent one another on the base so as to define joints between laterally adjacent blocks;

with said plurality of foam blocks being arranged in a plurality of rows of adjacent foam blocks;

each of the blocks having opposite front and rear edges, opposite sides, and a sloped upper surface, with the height of the blocks increasing in each row from front to back so as to form a continuous inclined plane;

a plurality of interface elements attached to the upper surfaces of the blocks so as to cover the joints;

a riser tie on each interface element; and riser face forms attached to the riser ties.

13. The assembly of claim 12 wherein each row has a curved front edge.

14. The assembly of claim 12 wherein each row has a straight front edge.

15. The assembly of claim 12 wherein the sides of adjacent blocks are spaced closer near the front edges than near the rear edges so as to form a curved riser face along a row of adjacent blocks.

16. The assembly of claim 12 wherein the sides of adjacent blocks being spaced so that the front and rear edges are equally spaced from one another so as to form a straight riser face along a row of adjacent blocks.

17. The assembly of claim 12 wherein the rear edges of the blocks in one row about the front edges of the blocks in the next adjacent rearward row.

18. The assembly of claim 12 wherein each interface element is a board extending substantially between the front and rear edges of the blocks.

19. The assembly of claim 12 wherein each of the riser ties includes a triangular wire body.

20. The assembly of claim 12 wherein the riser face forms are vertically oriented.

* * * * *